United States Patent [19]

Kohashi

[11] Patent Number: 4,667,689

[45] Date of Patent: May 26, 1987

[54] DISPLAY DEVICE OF CUMULATIVE AMOUNT OF MONEY FOR COINS

[75] Inventor: Narahisa Kohashi, Oita, Japan

[73] Assignee: Nishihara Shokai Co., Ltd., Oita, Japan

[21] Appl. No.: 742,490

[22] Filed: Jun. 7, 1985

[51] Int. Cl.[4] ..... G07D 9/00

[52] U.S. Cl. ..... 453/58; 194/227; 194/228; 235/100

[58] Field of Search ..... 133/1 R, 8 R; 194/1 L, 194/DIG. 3, 102, 225–228; 235/32, 100

[56] References Cited

U.S. PATENT DOCUMENTS

| | | | |
|---|---|---|---|
| 1,160,215 | 11/1915 | Turck | 235/32 |
| 1,187,808 | 6/1916 | Bozic | 235/100 |
| 1,660,799 | 2/1928 | Madsen | 235/32 |
| 1,718,583 | 6/1929 | Rooke | 235/32 |
| 1,718,584 | 6/1929 | Rooke | 235/32 |
| 1,805,132 | 5/1931 | Donnellan | 133/8 R |
| 2,103,084 | 12/1937 | Madsen | 235/32 |
| 3,022,938 | 2/1962 | Rosapepe | 235/100 |

*Primary Examiner*—Robert J. Spar

*Assistant Examiner*—P. McCoy Smith

*Attorney, Agent, or Firm*—Armstrong, Nikaido, Marmelstein & Kubovcik

[57] ABSTRACT

A display device which can mechanically and cumulatively count and display the amount of money for coins. The use of coins having a random relation between nominal values and diameters is possible by the provision of operation members. The operation members include carry operation members, each of the operation members has a corresponding digit display wheel which shows the cumulative amount of money. A coin inlet and guide member has pushing members for pushing a suitable operation member without pushing other operation members. To this end, the operation member other than the carry operation member each has at least one groove with a reception surface to which the pushing member abuts for pushing the operation member and an idle groove which is not actuated by another of the pushing members if it is guided into the idle groove. The idle groove serves as eliminating the problem of the random relation between nominal values and diameters of the coins.

4 Claims, 23 Drawing Figures

Table 1

| Coin | Diameter |
|---|---|
| 1 yen | 20 mm |
| 50 | 21 |
| 5 | 22 |
| 100 | 22.6 |
| 10 | 23.5 |
| 500 | 26.5 |

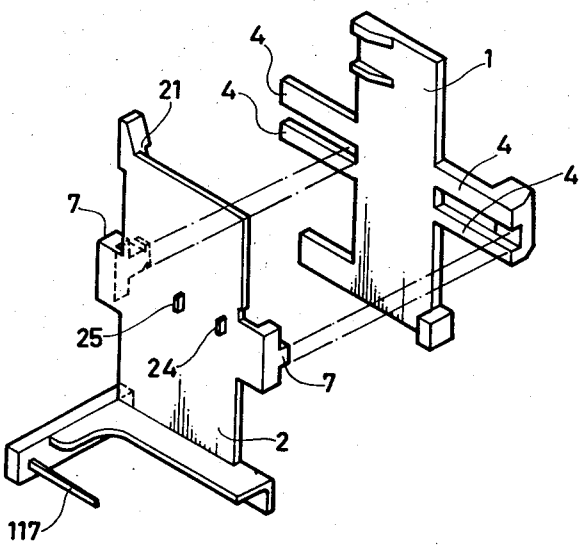
FIG. 14
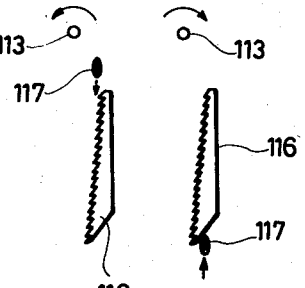
FIG. 16(A)
FIG. 16(B)

DISPLAY DEVICE OF CUMULATIVE AMOUNT OF MONEY FOR COINS

BACKGROUND OF THE INVENTION

1. Field of the Invention

The present invention relates to a device specifically used for coins for mechanically counting and displaying a cumulative amount of money.

2. Prior Art

There are known in the art various devices for counting or selecting coins. For example, known devices are a device for mechanically and cumulatively counting and displaying the number of coins without discriminating the kind of coins; a device for discriminating the kind of coins and collecting the same kind of coins without obtaining the cumulative amount of money; and a device for mechanically and cumulatively counting an amount of money only for particular coins. However, there are no such devices known for mechanically and cumulatively counting and displaying an amount of money with a single device for all of a plurality of coins available in commerce, such as in Japan, 1 yen, 5 yen, 10 yen, 50 yen, 100 yen, and 500 yen, and in U.S.A. 1 cent, 5 cent, 1 dime, quarter dollar, half dollar, and one dollar.

SUMMARY OF THE INVENTION

It is therefore an object of the present invention to provide a novel device which can mechanically and cumulatively count and display an amount of money for various kinds of coins, the device mechanically distinguishing all of the coins having different diameters and displaying the accumulated amount of money of the coins.

It is another object of the present invention to provide a mechanically and cumulatively counting and displaying device which is applicable to coins so long as they have different diameters from each other.

A brief description of the operating principle of the present invention will be described by taking as an example six different kinds of Japanese coins. Since all of the six coins have different diameters, a coin inserted into the device through a coin inlet is mechanically distinguished and the diameter of the coin is measured. With the measured result, a digit display wheel corresponding to the significant figure of the coin inserted is rotated to accumulate the significant figure on the wheel. For instance, upon insertion of a 1 yen coin, 1 is accumulated onto the ones order digit display wheel, or upon insertion of a 50 yen coin, 5 is accumulated onto the tens order digit display wheel. In this connection, the diameters of the six kinds of coins and the nominal money values of respective coins are not related with each other by any definite characteristic parameters. The order of nominal values and the order of diameters are random so that the digit display wheels disposed side by side in the order of from the smallest order digit to the largest order digit, can not correctly be operated upon unless some suitable means are incorporated. The main features of the present invention reside in that, in spite of the use of coins having a random relation between nominal values and diameters, the digit display wheels can correctly be rotated by way of new and novel operating members.

In accordance with the aspect of the present invention, a display device for mechanically counting and displaying a cumulative sum of money for coins comprises: a main frame; a coin inlet and guide member having a first coin peripheral reception portion and a predetermined number of pushing members, said coin inlet and guide member being capable of sliding laterally and perpendicularly within said main frame; a second coin peripheral reception portion fixedly mounted on said main frame facing said first coin peripheral reception portion, wherein a coin inserted into said coin inlet and guide member between said first and second coin peripheral portions makes said coin inlet and guide member move laterally by the amount substantially corresponding to the diameter of the inserted coin; a predetermined number of operation members including a carry operation member for exclusive use of carry operation, said operation members other than said carry operation member each having at least one groove with a reception surface to which one of said pushing members abuts and pushes its operation member down in the perpendicular direction as said coin inlet and guide member is moved down perpendicularly after said coin is inserted; and an idle groove which, if another of said pushing members is guided thereinto, said operation member will not be moved down in the perpendicular direction; digit display wheels the same in number as that of said operation members, said wheels being rotated by respective operation members by the amount corresponding to the downward perpendicular movement of said operation member in order to count the amount of money of said inserted coin; carry means for adding one digit to the next higher order digit display wheel, said carry means operatively provided between said digit display wheel and said operation member; and a clutch mechanism for coupling said operation member and said digit display wheel while said coin inlet and guide member is moved down in the perpendicular direction and for releasing said operation member and said digit display wheel while said coin inlet and guide member is moved up in the perpendicular direction.

The groove of the operation member in a second embodiment may have two reception surfaces located at different positions in the perpendicular direction, and said second coin peripheral portion includes first and second auxiliary coin peripheral reception portions, wherein said display device further comprises inlet selection means for selecting either of said first and second auxiliary coin reception portions, in accordance with the number of digit on a next-lower order digit display wheel.

Other objects and advantages of the invention will become apparent during the following discussion of the accompanying drawings, wherein FIG. 1 is a perspective and exploded view of the main portion of the device according a first embodiment of the present invention;

Figure 11A:
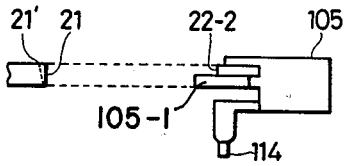
Figure 11B:
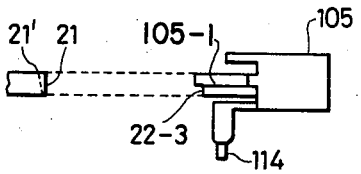
Figure 12:
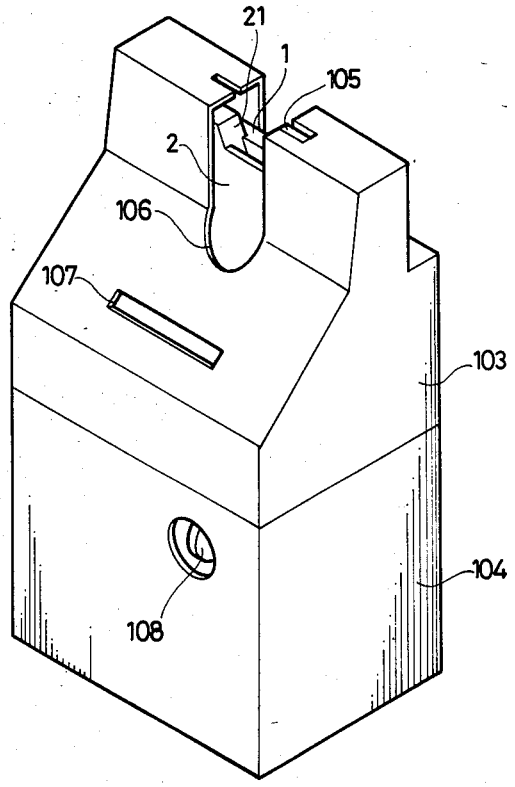
Figure 13:
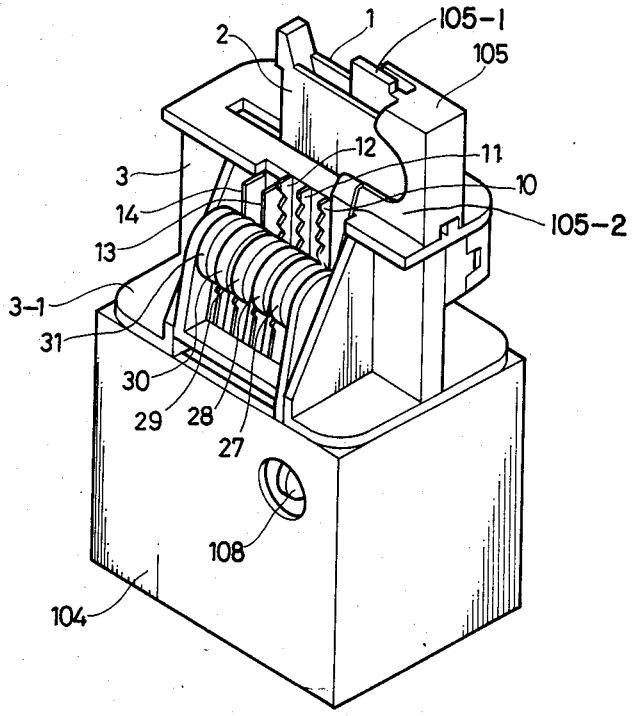
Figure 15:
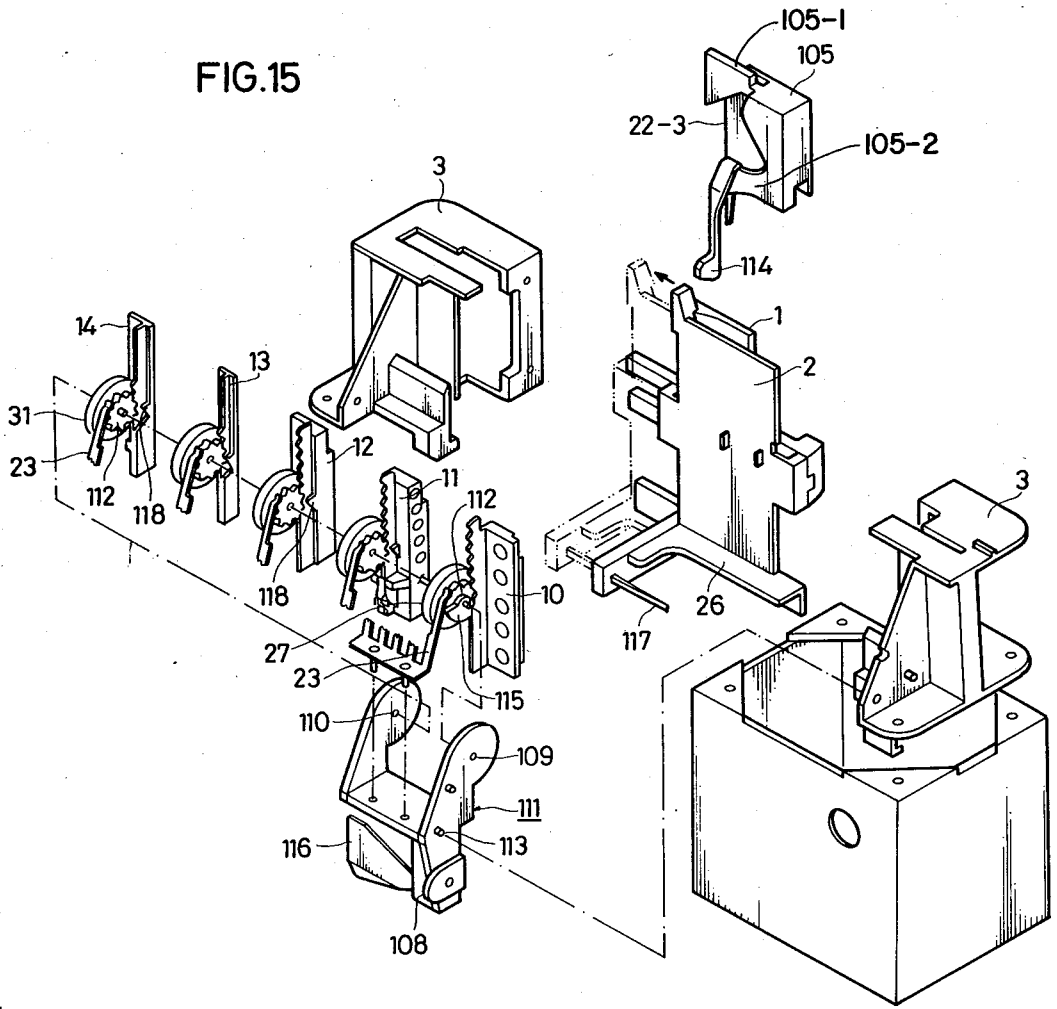

FIGS. 11 (A) and 11 (B) are plan views illustrating two inlets for coins;

FIG. 12 is a perspective view of the device according to the second embodiment of the present invention;

FIG. 13 is a perspective view of the device of FIG. 12 with a lid removed;

FIG. 14 is a perspective and exploded view of the motion member and the movable member;

FIG. 15 is a perspective and exploded view of the device according to the second embodiment of the present invention, and FIGS. 16 (A) and 16 (B) are views for explaining the operation of a ratchet mechanism for the pinions of the digit display wheel and the rack gear of the operation member.

DETAILED DESCRIPTION OF THE INVENTION

The present invention will now be described with reference to the accompanying drawings. FIGS. 1 to 9 show a first embodiment of the display device of the invention, and FIGS. 10 to 16 show a second embodiment of the display device of the invention.

First, referring to FIG. 1 which shows a perspective and exploded view of the display device according to the present invention, a laterally and perpendicularly movable member 2 (hereinafter referred to simply as the motion member) has at opposite sides a pair of protrusions 7, 7. The protrusions 7 and 7 are guided laterally or in the right and left directions along the parallel slide guides 4 and 4 formed on opposite sides of a perpendicualrly movable member 1 (hereinafter referred to as the movable member). The motion member 2 is coupled in slidable relation to the movable member 1 through the protrusions 7 and 7 and the slide guides 4 and 4 such that a space for coins to pass therethrough is retained between the two members 1 and 2. The motion member 2 is biased by a spring 8 toward the right in the drawing, while a spring 9 pushes the movable member 1 upwardly with its upper end inserted in an aperture 20. Numeral 21 represents a coin periphery reception portion, and numeral 22 represents a coin reception plate fixed to a main frame 3 (FIG. 3) of the device. The coin reception plate 22 has a coin periphery reception portion 22-1 facing the coin periphery reception portion 21. A coin inserted from above into the space or coin inlet between the motion and movable members 2 and 1 is first pushed down by hand so that the coin makes the motion member 2 slide to the left by the amount corresponding to the diameter of the coin. The coin periphery reception portion 22-1 is a reference surface for measuring the diameter of a coin and is fixed to the main frame of the device. However, the coin periphery reception portion 21 moves laterally in proportion to the diameter of the coin inserted. In the specification, since the coin is inserted from above, the lateral movement means the movement perpendicular to the direction of the coin insertion, while the perpendicular movement means the movement substantially in the same direction as that of the coin insertion.

Numerals 24 and 25 represent pushing members formed on the motion member 2 which project toward operation members described later. Numeral 26 represents a base for receiving the operation members.

The operation members 10 to 14 are used for coupling with digit display wheels described later. The operation member 10 is for the ones digit order, the operation member 11 is for the tens digit order, the operation member 12 is for the hundreds digit order, the operation member 13 is for the thousands digit order, and the operation member 14 is for the ten thousands digit order. The operation members 13 and 14 are used only for the carry operation, that is, adding one digit to a corresponding digit display wheel described later. The operation members 13 and 14 are called carry operation members where applicable. Each of the operation members 10 to 14 has a rack gear 10-1 through 14-1 at one side thereof. At the other side of each of the operation members 10 to 12 there are formed grooves described later, the grooves including at least one groove having a reception surface on the bottom thereof and an idle groove which, if another of the pushing member is guided thereinto, the operation member is not moved down in the perpendicular direction. As described later, one of the pushing members 24 and 25 abuts the reception surface and pushes the operation member while the motion member 2 is moved down in the perpendicular direction. However, the other of the pushing members 24 and 25 is guided in an idle groove at that time and does not act upon the operation member with the idle groove. At the right side of each of the operation members 11 to 14, a carry tooth 11-2 to 14-2 (which corresponds to the carry tooth of the second embodiment shown represented by numeral 118, refer to FIG. 15) is formed which is coupled to a carry tooth of the next-lower-order digit display wheel described later so that the digit of the display wheel corresponding to the former carry tooth is increased by one.

Figure 1:
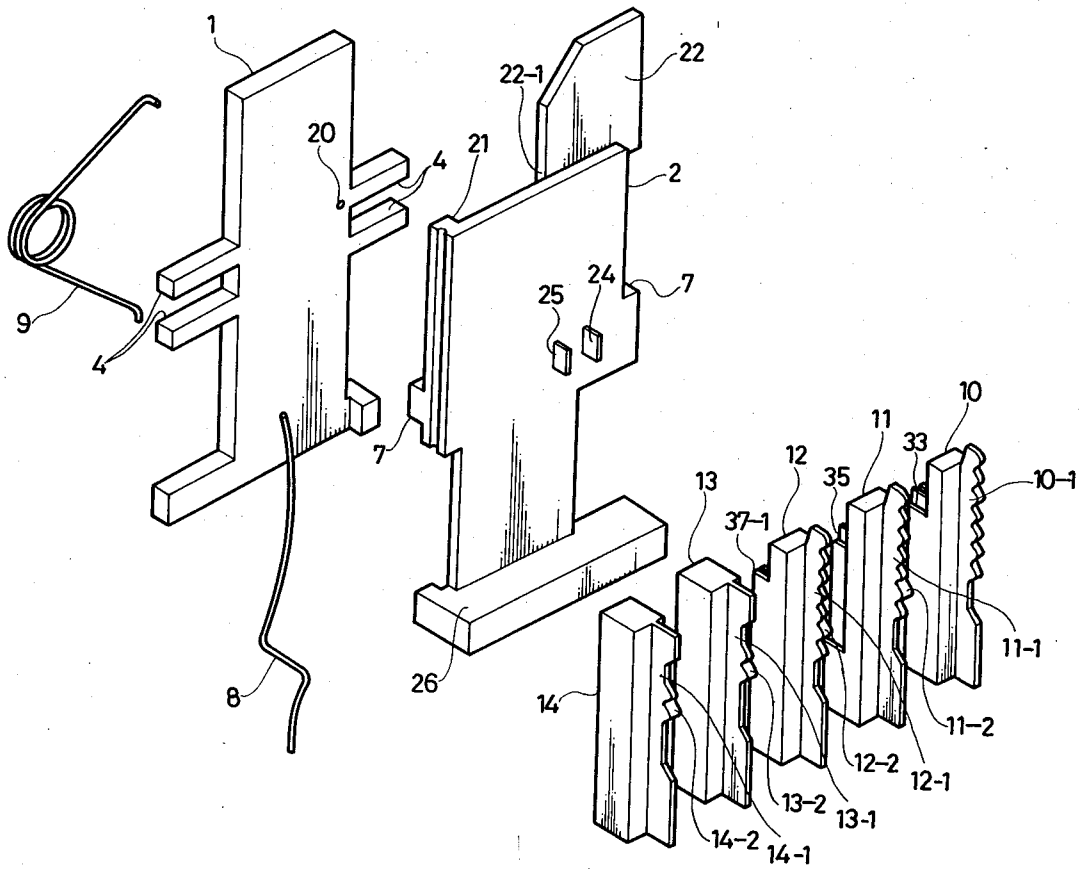
Figure 2:
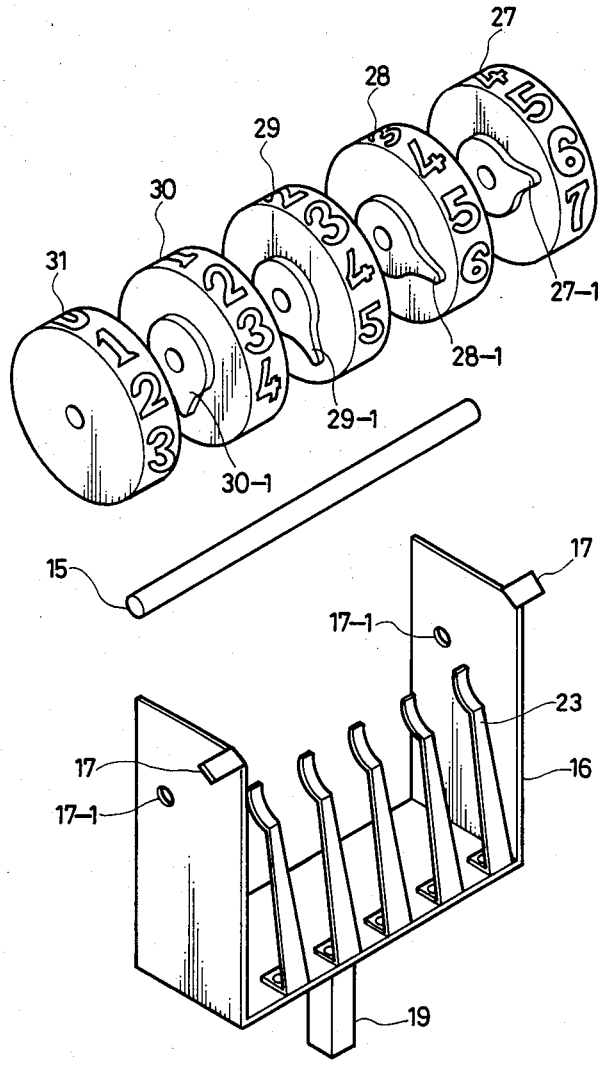
FIG. 2 is a perspective and exploded view of a counter section of the device shown in FIG. 1.

FIG. 2 is a perspective and exploded view of the main portion of a counter of the display device of the embodiment. Numerals 27 to 31 represent digit display wheels respectively for the ones, tens, hundreds, thousands, and ten thousands digit orders. Numerals 27-1 to 30-1 represent the carry teeth for adding one digit to the next-higher-order digit display wheel by coupling with the carry tooth (as mentioned above with FIG. 1) of the corresponding operation member. Each of the digit display wheels 27 to 31 is provided with a pinion positioned coaxially at the side not seen in the drawing (also in this case, in Fig. 15 of the second embodiment, pinions are represented by numeral 112). The digit display wheels 27 to 31 are rotatably mounted on a shaft 15 which is fixed at the openings 17-1 of a frame 16 of the counter. The frame 16 is integrally formed with flanges 17 and 17, five springs 23, and a manipulating bar 19. The five springs 23 each resiliently contact with a respective pinion of the digit display wheels 27 to 31.

Figure 3:
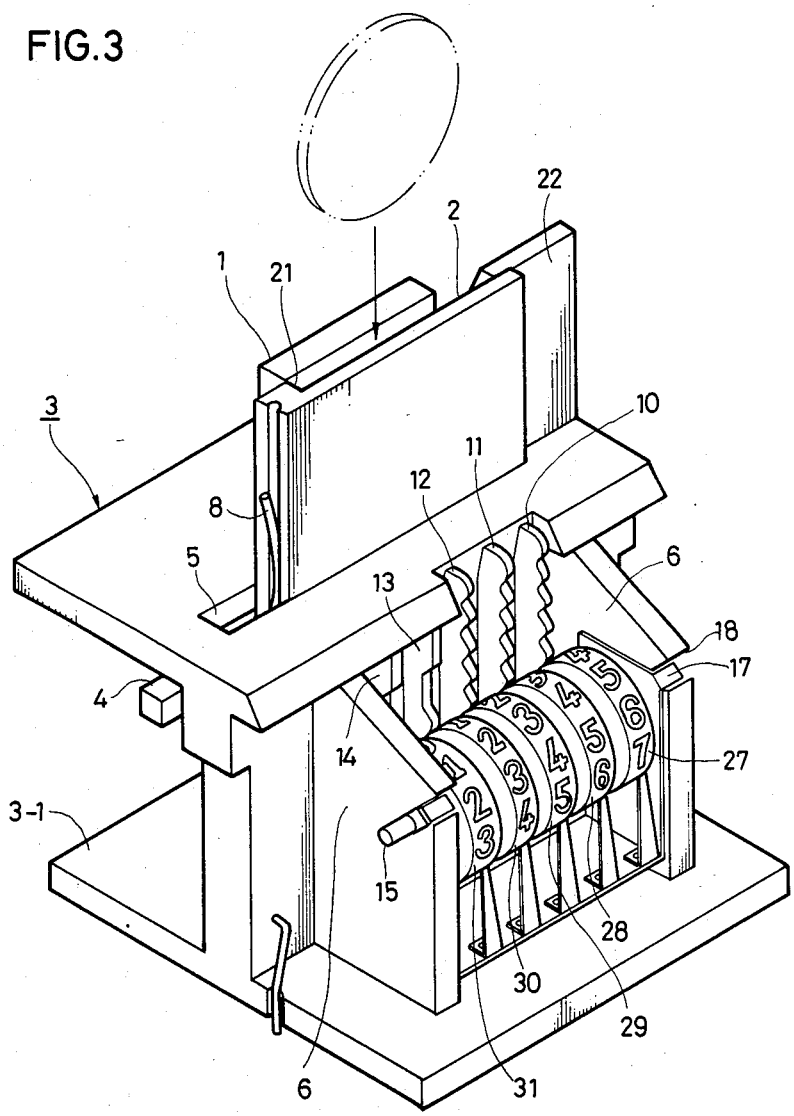
FIG. 3 is a perspective view of the whole part of the device of FIG. 1.
Figure 4:
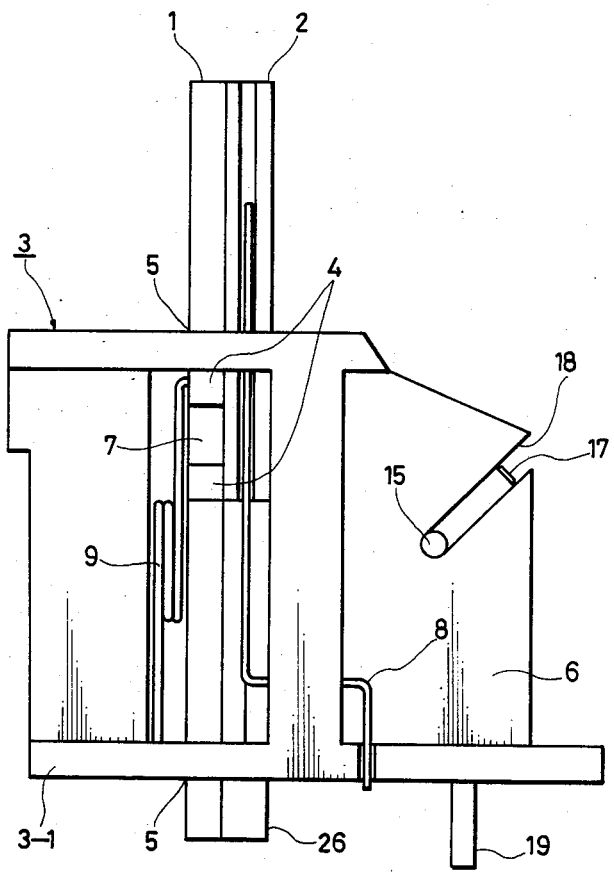
FIG. 4 is a side view of the device of FIG. 3.

FIG. 3 is a perspective view of the display device of the embodiment according to the present invention, and FIG. 4 shows a side view of FIG. 3. In the figures, the movable member 1, to which the motion member 2 is slidably coupled by means of the protrusions 7 and slide guides 4, slides perpendicularly along slide guides 5 formed on the main frame of the device. Therefore, with the lateral movement of the motion member 2 with respect to the movable member 1, the motion member 2 can slide laterally and perpendicularly relative to the main frame 3 of the device. The operation members 10 to 14 are housed within a slide guide 6 provided on the main frame 3 of the device and are slidable perpendicularly within the guide 6. The operation members 10 to 12 are operated by the pushing members 24 and 25, and as the motion member 2 is pushed down, one of the pushing members 24 and 25 pushes the operation member that has a reception surface abutting with a pushing member. In this case, the lower portions of the members 10 to 12 are so disposed to go below a bottom base 3-1 to a container (which is not shown) for coins is mounted. In contrast, the operation members 13 and 14 are operated only by the carry teeth of the digit display wheels 29 and 30.

While all of the operation members 10 to 14 are pushed down by the pushing member or the carry teeth of the digit display wheels 29 to 30, the pinions mesh with the rack gears 10-1 to 14-1. In the above case of pushing down the operation members 10 to 14, the coupling between the rack gears and the pinions is ensured by the fact that the shaft 15 and flanges 17 are moved downward along the slant notches 18 due to the gravity exerted upon the whole counter. However, when the operation members 10 to 14 are raised up by the upward motion of base 26 of the motion member 2 due to the force of spring 9 after the hand is released from the motion member 2, the counter supported by the shaft 15 on the slant notches 18 moves upward away from the rack gears within the notches 18 against gravity, so that the engagement of the rack gears 10-1 to 14-1 with the pinions of the operation members 10 to 14 is released. Thus, the counted value of the coin inserted is retained regardless of the return movement of the rack gears 10-1 to 14-1. The springs 23 serve to correctly feed each one tenth rotation of the digit display wheels while the operation member is pushed down with the pinions resiliently contacting with the springs 23. The notches 18, shaft 15 and flanges 17 serve as a one-way power transmission means.

In the same manner, the release operation can be manually conducted by raising upward the pushing bar 19 which extends through an opening formed in the bottom base 3-1 of the main frame 3. This manual operation is used when the counted value is desired to be cleared to zero or so by manually rotating the digit display wheels after the release of the engagement of the rack gears and the pinions.

Figure 5:
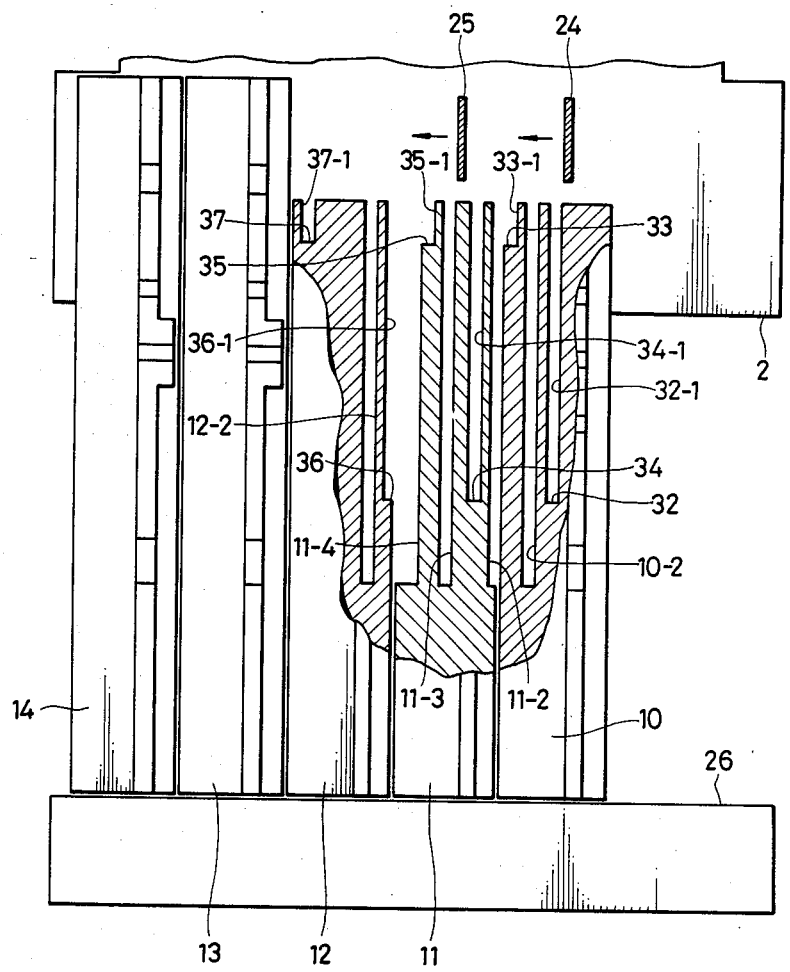
FIG. 5 is an enlarged and partially cut-away front view of the main part of the device of FIG. 1.

FIG. 5 is an enlarged diagram showing a positional relation between the pushing members 24 and 25 of the motion member 2 and the grooves formed at the opposite side of the rack gears 10-1 to 12-1 on the operation members 10 to 12, wherein a coin is not yet inserted into the space between the two coin periphery reception portions 21 and 22-1. In the figure, the operation member 10 is formed with a groove 32-1 with a reception surface 32 for receiving the pushing member 24, an idle groove 10-2, and a groove 33-1 with a reception surface 33 for receiving the pushing member 24. The operation member 11 is formed with an idle groove 11-2, a groove 34-1 with a reception surface 34 for receiving the pushing member 24, an idle groove 11-3, a groove 35-1 with a reception surface 35 for receiving the pushing member 25 in this case, and an idle groove 11-4. The operation member 12 is formed with a groove 36-1 with a reception surface 36, an idle groove 12-2, and a groove 37-1 with a reception surface 37. The reception surfaces 33 and 35 and the groove 37-1 are particularly shown in FIG. 1. The pushing members 24 and 25 are moved to the left side as shown by the arrows as a coin is pushed by hand and is inserted into the space between the two coin periphery reception portions 21 and 22-1. Thereafter, the motion member 2 together with the movable member 1 is pushed down by hand to thereby make the pushing members 24 and 25 engage with the grooves suitably formed for the coin inserted.

Figure 6:
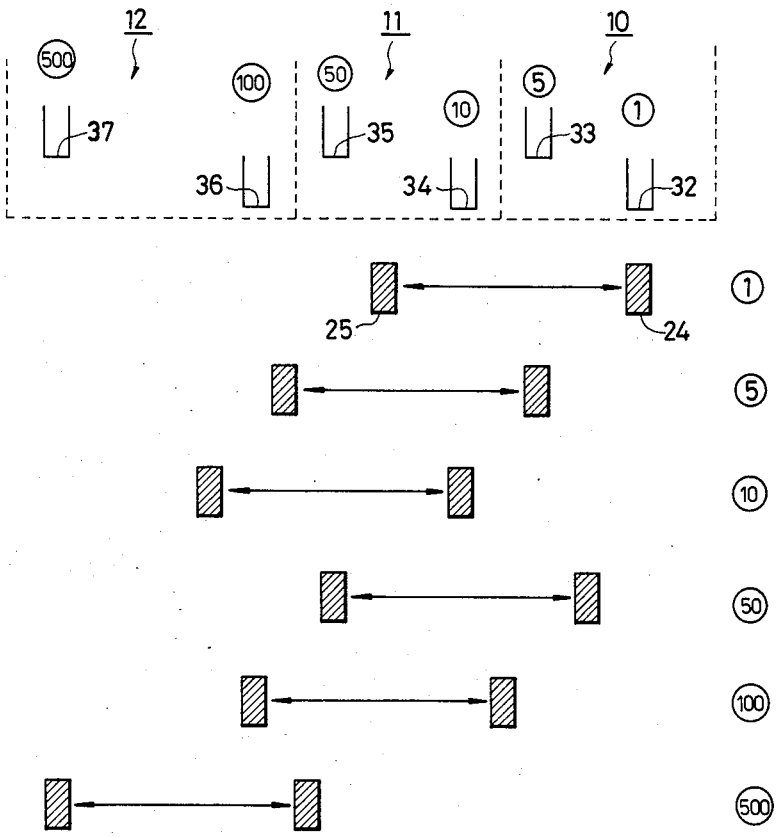
FIG. 6 is a diagram showing a positional relation between pushing members and reception surfaces.

An example of the relation between the reception surfaces 32 to 37 and the position of the pushing members 24 and 25 is illustrated in FIG. 6. Numbers enclosed with a circle represent the nominal value of a respective coin. As an example of coins, Japanese coins are used here. The coins have diameters of 20 mm, 21 mm, 22 mm, 22.6 mm, 23.5 mm, and 26.5 mm, respectively for the 1 yen, 50 yen, 5 yen, 100 yen, 10 yen, and 500 yen, as shown in Table 1. Various combinations of the number of pushing members, distance between pushing members, width of a pushing member, the positions of grooves with reception surface and of idle grooves, distance between grooves, width of a groove, are applicable to the present invention. In the first embodiment described above, the number of pushing members is two, the distance between the pushing members measured at the centers is set at 5 mm, and the width of the pushing member is set at 0.5 mm. The positions of the reception surfaces 33 to 37 are set apart from the reception surface 32, respectively by 2 mm, 3.5 mm, 6 mm, 7.6 mm, 11.5 mm. The width of the groove is set slightly wider than 0.5 mm of the width of the pushing member. The pushing member 24 pushes the reception surfaces 32, 33, and 34, respectively for the 1 yen, 5 yen, and 10 yen coins, while the pushing member 25 pushes the reception surfaces 35, 36, and 37, respectively for the 50 yen, 100 yen, and 500 yen coins. The pushing member which does not push a reception surface is guided in an idle groove and does not acts upon an operation member.

The operation of the device constructed as above will be described. As shown in FIG. 3, by inserting a coin into the space defined by the movable and motion members 1 and 2 between the two coin periphery reception portions 21 and 22-1, the distance between the two coin periphery reception portions is made larger until it becomes the same as the diameter of the coin. At this state, upon pushing down the motion member 2 together with the movable member 1, one of the pushing members 24 and 25 abuts the reception surface of the suitable groove for the coin inserted so that the rack gear of the corresponding operation member is pushed down by a predetermined distance to thereby rotate the digit display wheel by a predetermined angle. The predetermined distance is determined by the stroke of the motion member 2 in the downward movement and by the position of the reception surface. In this case, the other pushing member does not act upon an operation member since the idle groove is made deeper in the perpendicular direction than the reception surface of the groove along which the one pushing member is guided.

During the downward movement of the motion member 2 and the movable member 1, after the one of the pushing members is guided into the groove, the coin drops onto the container because the fixed coin periphery reception portion 22-1 is no longer in a contact relation with the periphery of the coin. In this case, although the motion member 2 is urged in the right direction by the spring 8, the pushing members are already inserted in the grooves and retained in place until the motion member 2 is pushed to the bottom. After releasing the hand from the motion member 2, the motion member 2 is raised upward by the spring 9 and the pushed down operation member is returned to the initial position by the base 26 of the motion member 2.

In the course of the upward movement of the motion member 2, as previously described, since the shaft 15 moves apart from the rack gear along the notches 18, the digit display wheel having been rotated by a predetermined angle stops at that position. The spring 23 serves to correctly feed each one tenth rotation of the digit display wheel while the operation member is pushed down with the pinions resiliently contacting with the springs 23.

Figure 7A:
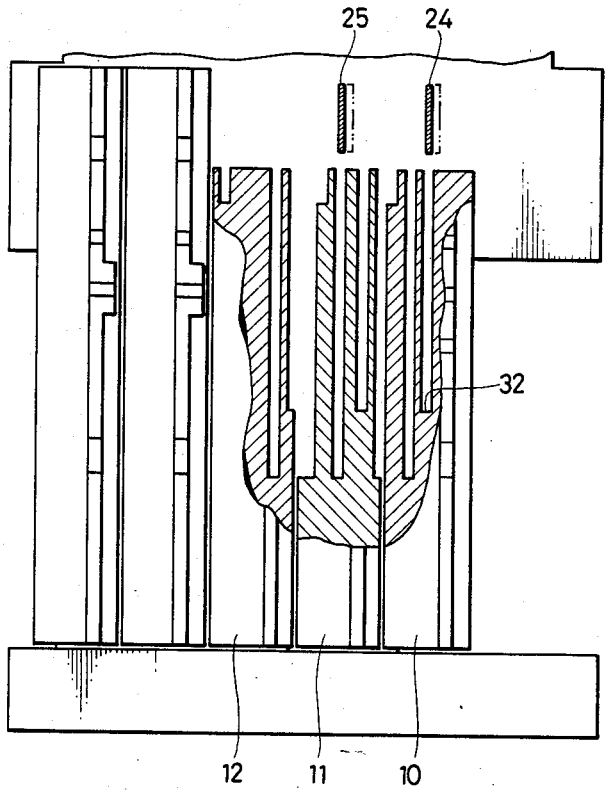
FIG. 7 to 9 are diagrams for explaining the operation of the device of FIG. 1.
Figure 7B:
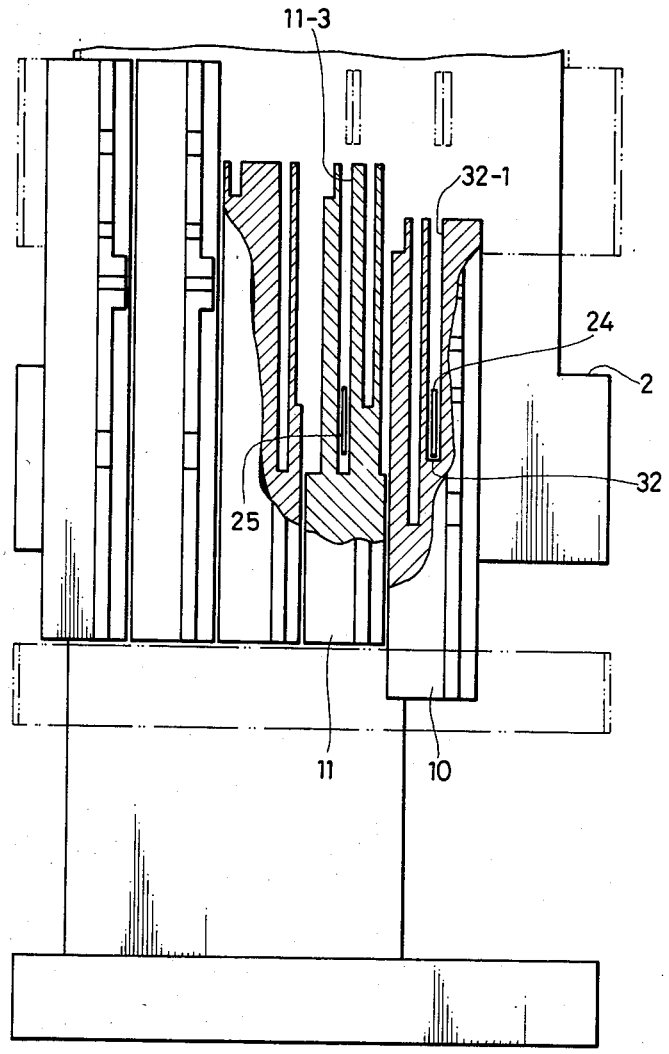
Figure 8:
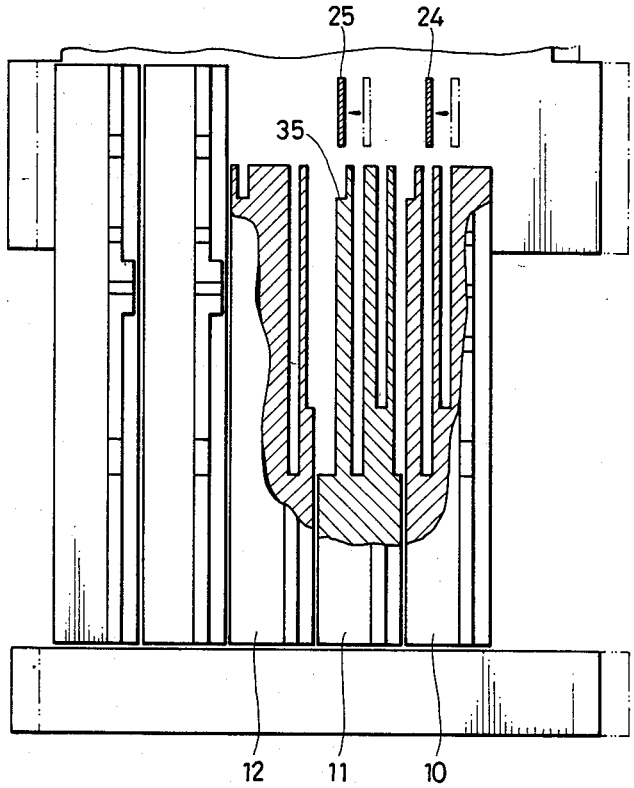
Figure 8B:
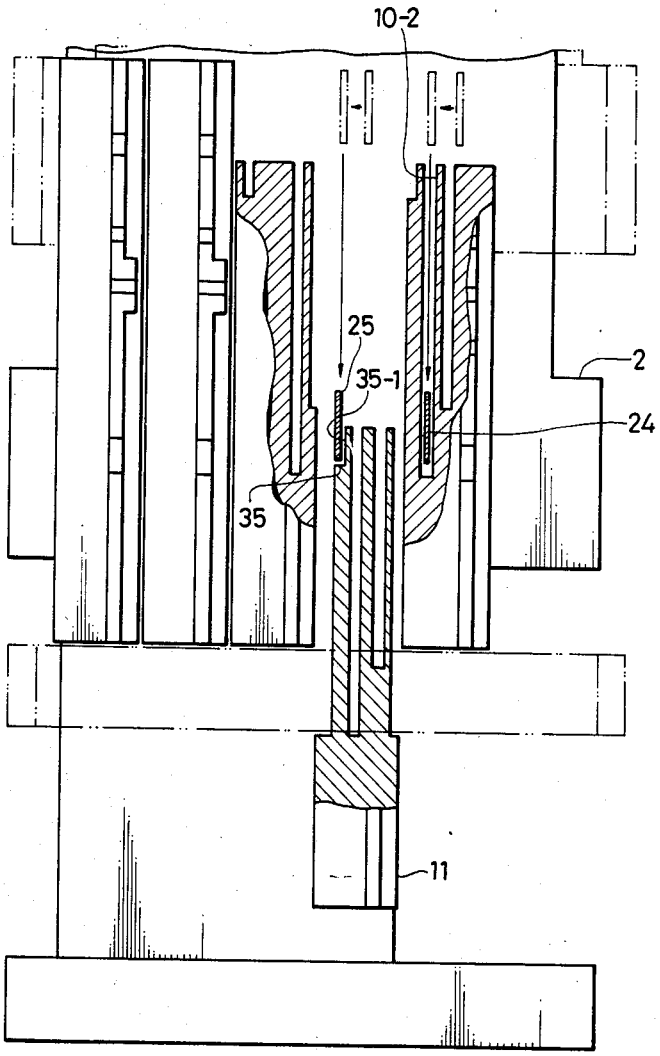
Figure 9:
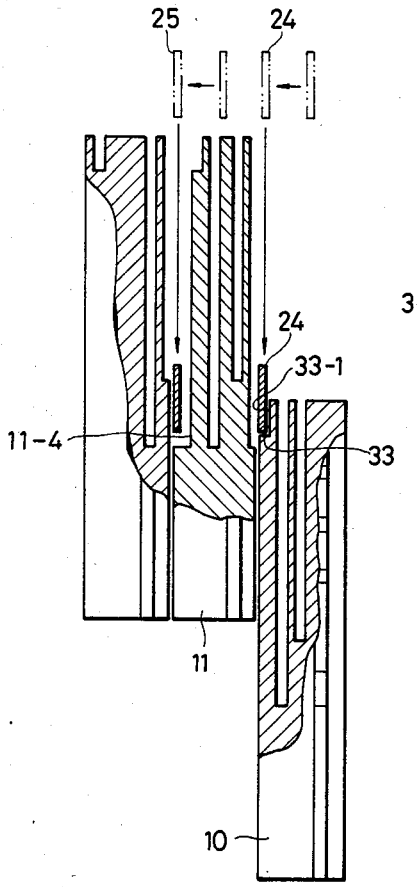
Figure 9:
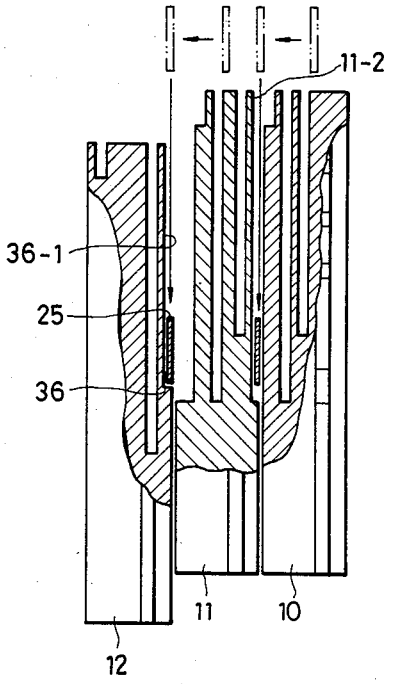
Figure 9:
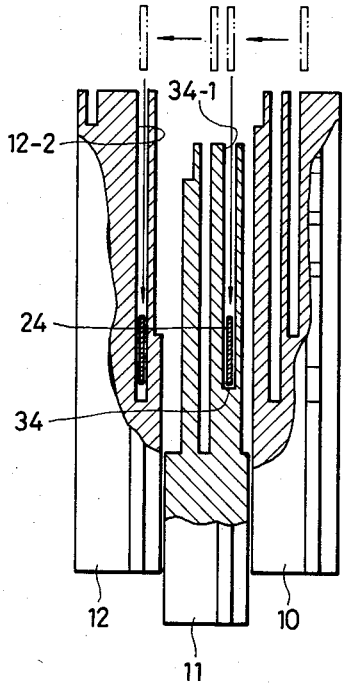
Figure 9:
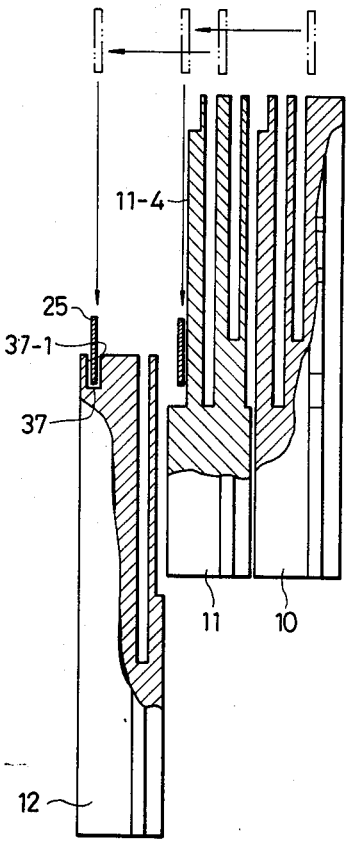

More particularly referring now to FIGS. 7 to 9, the operation will be explained. FIGS. 7 and 8 show the relative movement of the pushing members 24 and 25 and the operation members 10 and 11 when the 1 yen and 50 yen coins are used, respectively. FIG. 9 shows the relative movement of the pushing members 24 and 25 and the operation members 10, 11, and 12 when the 5 yen, 100 yen, 10 yen, and 500 yen coins are used.

FIG. 7 (A) shows a state at which the smallest 1 yen coin of about 20 mm diameter is inserted into the space between the two coin periphery reception portions 21 and 22-1, the two pushing members 24 and 25 being displaced in the left direction from the position shown by a one-dot-chain line. From this state, upon depression of the motion member 2, a state as shown in FIG. 7 (B) is obtained. As seen from FIG. 7 (B), the pushing member 25 goes downward along the idle groove 11-3 of the operation member 11 and never moves the operation member 11 while the operation member 10 is pushed down by the pushing member 24 abutting the reception surface 32. The depth of the groove 32-1 to the bottom reception surface 32 is so determined as to move the operation member 10 by the amount corresponding to the one digit angle of the display wheel 27, when the motion member 2 is pushed down to the bottom. Since only the operation member 10 is pushed down by a predetermined distance, the rack gear meshing with the pinion of the ones digit display wheel 27 makes the latter rotate by one digit to thereby accumulate the count value of the coins.

FIG. 8 (A) shows a state at which the second smallest 50 yen coin of about 21 mm diameter is inserted into the space between the two coin periphery reception portions 21 and 22-1, the two pushing members 24 and 25 being displaced in the left direction from the position shown by a one-dot-chain line. From this state, upon depression of the motion member 2, a state as shown in FIG. 8 (B) is obtained. As seen from FIG. 8 (B), the pushing member 24 goes downward along the idle groove 10-2 of the operation member 10 and never moves the operation member 10 while the operation member 11 is pushed down by the pushing member 25 abutting the reception surface 35. The depth of the groove 35-1 to the bottom reception surface 35 is so determined as to move the operation member 11 by the amount corresponding to the five digit angle of the display wheel 28, on condition that the motion member 2 is pushed down to the bottom. Since only the operation member 11 is pushed down by a predetermined distance, the rack gear meshing with the pinion of the tens digit display wheel 28 makes the latter rotate by five digits or half a rotation to thereby add 50 yen to the count value of the coins.

FIG. 9 (A) shows a state where a 5 yen coin is inserted and the pushing members 24 and 25 are guided into the grooves, the former pushing member abutting the reception surface 33 of the groove 33-1 and the latter pushing member 25 positioning in idle state within the idle groove 11-4. FIG. 9 (B) shows a state where a 100 yen coin is inserted and the pushing members 24 and 25 are guided into the grooves, the former pushing member positioning in idle state within the idle groove 11-2 and the latter pushing member abutting the reception surface 36 of the groove 36-1. FIG. 9 (C) shows a state where a 10 yen coin is inserted and the pushing members 24 and 25 are guided into the grooves, the former pushing member abutting the reception surface 34 of the groove 34-1 and the latter pushing member positioning in idle state within the idle groove 12-2. FIG. 9 (D) shows a state where a 500 yen coin is inserted and the pushing members 24 and 25 are guided into the grooves, the former positioning in idle state within the idle groove 11-4 and the latter pushing member abutting the reception surface 37 of the groove 37-1. The counting operation for the coins 5, 100, 10, and 500 yen coins is similar to that described with respect to the 1 and 50 yen coins.

In the above counting operations, in any case that the digit 9 is advanced to the digit 0 while the digit display wheel rotates, the carry teeth 27-1 to 30-1 shown in FIG. 2 couples with the carry tooth of the next-higher-order operation member, the latter carry tooth being formed at one side of the rack gear 11-1 to 14-1 shown in FIG. 1, as described previously. Thus, the carry teeth 27-1 to 30-1 pushes down the corresponding tooth 11-2 to 14-2 of the next-high-order digit operation member so that the display wheel of next-higher-order digit is rendered to move by one digit or one tenth of a revolution. The digit carry mechanism may be embodied by using a known subshaft with a gear wheel.

In the above embodiment, although two pushing members have been provided for actuating upon the operation members, a single pushing member is also applicable. In this case also, the reception surface is formed at the position corresponding to the diameter of each coin. However, since the positions of the reception surfaces are not in the order of the nominal value of coins, the portion carrying a reception surface which extends over the area where another operation member moves, must be so arranged not to obstruct the movement of the other operation member.

The arrangement of the movable member 1 and the motion member 2 may have another arrangement. For example, a lateral movable member is mounted on the main frame 3, and a perpendicularly movable member provided with the pushing members 24 and 25 is mounted on the lateral movable member, thereby enabling the same function of the movable member 1 and the motion member 2 as a whole. Furthermore, although the slide guide 4 for lateral movement of the motion member 2 and the slide guide 5 for perpendicular movement of the motion member are crossed at a right angle, it is not intended to be limited to a right angle. The motion member 2 may be constructed to move along a curved line instead of a straight line as of the above embodiment.

Since the difference between the diameters of coins is small, the positions of the pushing members 24 and 25 may be enlarged by means such as levers or gear wheels.

The one-way power transmission mechanism constructed from the combination of the notches 18, shaft 15 and flanges 17 may have another construction. For example, by forming the notches 18 at the position rotated by 90 degrees from the position of the embodiment, it is possible to arrange such that the digit display wheel is not rotated while the operation member is pushed down but the digit display wheel is rotated when the operation member is raised to return to its original position. Alternatively, it is possible to mount a ratchet mechanism between the digit display wheel and the rack gear so as to make the digit display wheel rotate in only one direction. Furthermore, a push-pull rod may be used to actuate the digit display wheel through the operation member. The combination of the carry tooth and that of the digit display wheel may be replaced with another combination such as a gear mounted on the digit display wheel.

The device may be used for such apparatuses requiring means for cumulatively counting the amount of money for coins, or may be used for a savings box in which the container for the coins is fixed underneath the base 3-1 of the main frame 3 of the device. The container may take any shape or be made of any material, such as box, circular tube, wood, metal and so on.

FIGS. 10 to 16 show a second embodiment of the device according to the present invention. Briefly speaking, the main difference from the first embodiment resides in that the second embodiment enables counting a quarter dollar or 25 cents with two significant digits and a mechanism to ensure a reliable ratchet operation for the digit display wheel is provided. In the figures, similar or identical elements as those in the first embodiment are represented by using the same numbers, and the description thereof is omitted.

First, the operation principle of counting the 25 cents will be described. If the nominal value of a coin has only a single significant digit, such as one dollar, ten cents, and so on, the operation member to be actuated is as described in detail in the first embodiment, and the carry operation at that time can be smoothly performed by means of the carry teeth of both the digit display wheel and the operation member. However, if the coin to be counted has two significant digits such as 25 cents, then the counting operation is not so simple because the digit display wheel for the tens digit must be subject to the simultaneous actuations from the ones digit display wheel and from the tens digit operation member.

Figure 10:
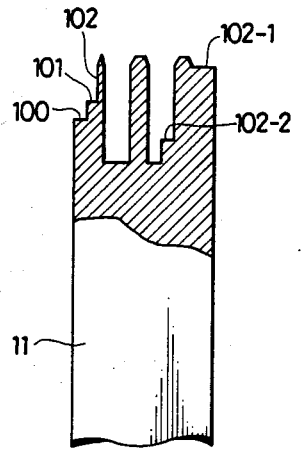
FIG. 10 is a partially cut-away view of an operation member according to a second embodiment of the present invention.

In particular, if the ones digit is any one of 0 to 4 prior to counting the 25 cents, then the addition operation of 25 cents is simply performed by merely adding 5 to the ones digit and 2 to the tens digit. However, if the ones digit is any one of 5 to 9, this is not as simple as above. The reason for this is that although the ones digit suffices by simply adding 5, the tens digit must be added by 3, that is, 1 out of the 3 being for the carry digit from the ones digit and 2 out of the 3 being for 2 of the tens digit of 25 cents. In order to distinguish the above two cases, that is, the case of addition of 2 to the tens digit and the case of addition 3 to the tens digit (where 1 is from the carry and 2 is from the 2 of the ten digit), two reception surfaces 100 and 101 are formed for the groove 102 serving as the groove for use in adding 2 of the tens digit of 25 cents, for example as shown in FIG. 10. In the case of addition of 2, the reception surface 100 is used, while in the case of addition 3, the reception surface 101 is used. To this end, according to the second embodiment, two inlets are provided for a 25 cents coin, respectively in the case of addition of 2 and in the case of addition of 3. The two inlets are automatically selected by means of an inlet selection device described later. In FIG. 10, numerals 102-1 and 102-2 represent coin reception surfaces for 50 cent coin and 10 cent coin, respectively.

In particular, referring to FIGS. 11 (A) and 11 (B) which show plan views in association with the motion member 2 and movable member 1, in the case of the addition of 2, a fixed coin periphery reception portion 22-3 is selected by the inlet selection device 105 as shown in FIG. 11 (B), while in the case of the addition of 3, a fixed coin periphery reception portion 22-2 is selected by the inlet selection device 105 as shown in FIG. 11 (A).

Referring now to FIGS. 12 to 15, the second embodiment of the device will be described. FIG. 12 is a perspective view of the display device with a lid 103. The lid 103 is mounted upon the coin container 104 in which counted coins are accommodated. The lid 103 is formed with two openings, one 106 communicating to the space (coin inlet) between the motion member 2 and the movable member 1 and the other 107 being for accessing or viewing the digit display wheel. The container 104 is formed with another opening through which an actuation lever 108 of a counter support 111 can be operated by manually pushing it. FIG. 13 is a perspective view of the device with the lid 103 removed. FIG. 14 is a perspective view of the motion member 2 and the movable member 1. FIG. 15 is a perspective and exploded view of the device.

Referring now particularly to FIG. 15, the digit display wheels 27 to 31 are rotatably supported by a not shown shaft fixedly coupled between two holes 109 and 110 formed in a counter support 111. The integrally formed springs 23 are connected to the counter support and coupled to the pinions 112 of the wheels 27 to 31. The counter support 111 is pivotally supported on the main frame 3 by shafts 113 and energized by a not show spring so as to ensure the coupling between the rack gears and the pinions 112. The counter support 111 can be manually operated by pushing the actuation lever 108 so that the coupling between the rack gears and the pinions 112 can be released. The actuation lever 108 corresponds to the pushing bar 19 of the first embodiment.

The inlet selection device 105, having upper coin inlet selector 105-1 and front edge 105-2, mounted using the front bottom edge 105-2 as a fulcrum for swinging or pivoting the inlet device 105; on the main frame 3. The inlet selection device 105 is formed with a cam follower 114 so that the upper coin inlet selector 105-1 and the cam follower 114 swings back and forth by which the device 105-1 is moved to take either one of the positions as of FIG. 11 (A) or FIG. 11 (B) in accordance with the position of a cam 115 which pushes cam follower 114, mounted on the ones digit display wheel 27. That is, if the ones digit display wheel 27 takes the position of one of the numbers 0 to 4, the inlet selection device 105, in particular 105-1, is moved cover up the periphery reception portion 22-2 to the state of FIG. 11 (B). In this case, a coin is inserted between the coin periphery reception portions 21 and 22-3 so that a 2 will be added to the tens digit. Alternatively, if the ones digit display wheel 27 takes the position of one of the numbers 5 to 9, the inlet selection device 105, in particular 105-1, is moved to cover up the periphery reception portion 22-3 to the state of FIG. 11 (A) so that a 3 (1 from the carry digit and 2 from the tens digit) will be added to the tens digit. In this case, a coin is inserted between the coin periphery reception portions 21 and 22-2. The coin periphery reception portions 22-2 and 22-3 are both fixed relative to the main frame 3. Since the distance between the portions 21 and 22-2 and that between the portions 21 and 22-3 are made different, in response to the digit of the ones digit display wheel 27 at the time when a coin is inserted, the length of movement of the motion member 2 differs. Therefore, the reception surfaces 100 and 101 (FIG. 10) can be correctly selected.

The difference of the distances in the two cases occurs in the other coins having one significant digit, such as one dollar or the like. In this case, the width of the groove for that digit must have the same width as of the groove 102 (FIG. 10). In order to narrow the width of the groove, it is possible to form the coin reception portion 21 to have a slant surface 21' as shown by a dot line in FIG. 11. With the slant surface 21', the inserted coin is moved to the remotest portion of the slant surface 21' as seen from the fixed reception portion 22-2 or 22-3, while the coin is pushed down into the space. Therefore, the difference of the distances in the two cases, that is, the ones digit being 0 to 4 and 5 to 9, can be shortened so that the width of the groove can be narrowed.

The one-way power transmission mechanism constructed from the combination of the notch 18, shaft 15, and flanges 17 in the first embodiment is replaced with a combination of a guide wing 116 fixedly connected to the counter support 111 and a pushing pin 117 fixedly connected to the motion member 2. As shown in FIGS. 16 (A) and 16 (B), the pushing pin 117 is located slightly inside of the guide wing 116 (FIG. 16 (A)) when the motion member 2 is not pushed down. Thereafter, as the motion member 2 is pushed down, the pushing pin 117 pushes the guide wing 116 so that the shaft 113 of the counter frame is rotated in the direction of the arrow (FIG. 16 (A)). Thus, during the downward movement of the motion member 2, the coupling of the rack gears with the pinions 112 is ensured. On the other hand, when the motion member 2 is pushed down to the bottom, the pushing pin 117 is located slightly outside of the guide wing 116 (FIG. 16 (B)). Thereafter, as the motion member 2 is raised by a not shown spring (corresponding to the spring 9 of the first embodiment), the pushing pin 117 pushes the guide wing 116 in the opposite direction to the above so that the shaft 113 of the counter support 111 is rotated in the direction of the arrow of FIG. 16 (B). Thus, during the upward movement of the motion member 2, the coupling of the rack gears with the pinions 112 is released.

What is claimed is:

1. A display device for mechanically counting and displaying a cumulative sum of money for coins comprising;

a main frame;

a coin inlet and guide member having a first coin periphery reception portion and a predetermined number of pushing members, said coin inlet and guide member being capable of sliding laterally and perpendicularly within said main frame;

a second coin periphery reception portion fixedly mounted on said main frame facing said first coin periphery reception portion, wherein a coin inserted into said coin inlet and guide member between said first and second coin periphery portions makes said coin inlet and guide member move laterally by the amount substantially corresponding to the diameter of the inserted coin;

a predetermined number of operation members including a carry operation member for exclusive use of carry operation, said operation members other than said carry operation member each having at least one groove with a reception surface to which one of said pushing members abuts and pushes down in the perpendicular direction its operation member as said coin inlet and guide member is moved down perpendicularly after said coin is inserted; and an idle groove into which if another of said pushing members is guided, said operation member will not move down in the perpendicular direction;

digit display wheels the same in number as that of said operation members, said wheel being rotated by said operation member by the amount corresponding to the downward perpendicular movement of said operation member in order to count the amount of money of said inserted coin;

carry means for adding one digit to the next higher order digit display wheel, said carry means operatively provided between said digit display wheel and said operation member; and a clutch mechanism for coupling said operation member and said digit display wheel while said coin inlet and guide member is moved down in the perpendicular direction and for releasing said operation member and said digit display wheel while said coin inlet and guide member is moved upward in the perpendicular direction.

2. A display device according to claim 1, wherein said groove has two reception surfaces located at different positions in the perpendicular direction, and said second coin periphery portion includes first and second auxiliary coin periphery reception portions, said display device further comprising inlet selection means for selecting either of said first and second auxiliary coin reception portions, in accordance with the number of digit of the next-lower order digit of said digit display wheel.

3. A display device for mechanically counting and displaying a cumulative sum of money for coins comprising:

a main frame provided with a first guide mechanism;

a motion member having a first coin periphery reception portion and a predetermined number of pushing members, said motion member being capable of sliding along said first guide mechanism with the help of a movable member having a second guide mechanism;

a second coin periphery reception portion formed on said main frame facing said first coin periphery reception portion;

a predetermined number of operation members each having at predetermined positions a predetermined number of reception surfaces receiving said pushing members, said operation members being slidably mounted along a third guide mechanism formed on said main frame; and a clutch mechanism which is constructed so as to cooperatively move each of said operation members and a corresponding digit display wheel of a counter.

4. A display device according to claim 3, wherein said motion member is disposed so as to directly slide along said first guide mechanism of the main body.

* * * * *